US006615003B2

(12) United States Patent
Nakayama

(10) Patent No.: US 6,615,003 B2
(45) Date of Patent: Sep. 2, 2003

(54) IMAGE FORMING APPARATUS

(75) Inventor: Hiroshi Nakayama, Kawasaki (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/955,089

(22) Filed: Sep. 19, 2001

(65) Prior Publication Data

US 2003/0053812 A1 Mar. 20, 2003

(51) Int. Cl.[7] ..... G03G 15/00; G03G 15/20
(52) U.S. Cl. ..... 399/44; 399/69
(58) Field of Search ..... 399/44, 67, 69, 399/70

(56) References Cited

U.S. PATENT DOCUMENTS 6,389,247 B1 5/2002 Chung ..... 399/69

FOREIGN PATENT DOCUMENTS

| | | |
|---|---|---|
| JP | 2-22684 | 1/1990 |
| JP | 3-111880 | 5/1991 |
| JP | 1-74018 | 3/1998 |
| JP | 10-104975 | 4/1998 |
| JP | 2001318558 | 11/2001 |

*Primary Examiner*—Quana M. Grainger
(74) *Attorney, Agent, or Firm*—Foley & Lardner

(57) ABSTRACT

The present invention is applied to an induction heater. When the successive ON time of an IH ON signal becomes longer than an error sensing time during a warming-up processing, the present invention determines a temperature higher than a ready temperature. In response to this determination, the supply of the IH ON signal to a high-frequency ON/OFF circuit 116 is stopped. As a result, the supply of a high-frequency current from the high-frequency ON/OFF circuit 116 to a coil 105 is prohibited, and a heating roller 58*b* is prevented from overheating or igniting.

4 Claims, 9 Drawing Sheets

94a

| Connection | | | | | WUP | | | | PRE-RUN | | | |
|---|---|---|---|---|---|---|---|---|---|---|---|---|
| RADF | FIN | FAX | PRN | DSS | – | INI | SCN | RADF | – | INI | SCN | RADF |
| – | – | – | – | – | 1300 | 1300 | 1300 | – | 1250 | 1250 | 1250 | – |
| ○ | – | – | – | – | 1300 | 1300 | 1300 | 1250 | 1250 | 1250 | 1250 | 1200 |
| – | ○ | – | – | – | 1250 | 1250 | 1250 | – | 1200 | 1200 | 1200 | – |
| ○ | ○ | – | – | – | 1250 | 1250 | 1250 | 1200 | 1200 | 1200 | 1200 | 1100 |
| – | – | ○ | – | – | 1300 | 1300 | 1300 | – | 1250 | 1250 | 1250 | – |
| ○ | – | ○ | – | – | 1300 | 1300 | 1300 | 1250 | 1250 | 1250 | 1250 | 1200 |
| – | ○ | ○ | – | – | 1250 | 1250 | 1250 | – | 1200 | 1200 | 1200 | – |
| ○ | ○ | ○ | – | – | 1250 | 1250 | 1250 | 1200 | 1200 | 1200 | 1200 | 1100 |
| – | – | – | ○ | – | 1200 | 1200 | 1200 | – | 1100 | 1100 | 1100 | – |
| ○ | – | – | ○ | – | 1200 | 1200 | 1200 | 1100 | 1100 | 1100 | 1100 | 1000 |
| – | ○ | – | ○ | – | 1100 | 1100 | 1100 | – | 1000 | 1000 | 1000 | – |
| ○ | ○ | – | ○ | – | 1100 | 1100 | 1100 | 1000 | 1000 | 1000 | 1000 | 900 |
| – | – | ○ | ○ | – | 1200 | 1200 | 1200 | – | 1100 | 1100 | 1100 | – |
| ○ | – | ○ | ○ | – | 1200 | 1200 | 1200 | 1100 | 1100 | 1100 | 1100 | 1000 |
| – | ○ | ○ | ○ | – | 1100 | 1100 | 1100 | – | 1000 | 1000 | 1000 | – |
| ○ | ○ | ○ | ○ | – | 1100 | 1100 | 1100 | 1000 | 1000 | 1000 | 1000 | 900 |
| – | – | – | – | ○ | 1200 | 1200 | 1200 | – | 1100 | 1100 | 1100 | – |
| ○ | – | – | – | ○ | 1200 | 1200 | 1200 | 1100 | 1100 | 1100 | 1100 | 1000 |
| – | ○ | – | – | ○ | 1100 | 1100 | 1100 | – | 1000 | 1000 | 1000 | – |
| ○ | ○ | – | – | ○ | 1100 | 1100 | 1100 | 1100 | 1000 | 1000 | 1000 | 900 |
| – | – | ○ | – | ○ | 1200 | 1200 | 1200 | – | 1100 | 1100 | 1100 | – |
| ○ | – | ○ | – | ○ | 1200 | 1200 | 1200 | 1100 | 1100 | 1100 | 1100 | 1000 |
| – | ○ | ○ | – | ○ | 1100 | 1100 | 1100 | – | 1000 | 1000 | 1000 | – |
| ○ | ○ | ○ | – | ○ | 1100 | 1100 | 1100 | 1000 | 1000 | 1000 | 1000 | 900 |

FIG. 3

IMAGE FORMING APPARATUS

BACKGROUND OF THE INVENTION

1. Field of the Invention

The present invention relates to an image forming apparatus wherein a coil generates a high-frequency magnetic field, the high-frequency magnetic field is applied to a heat generation member to produce an eddy current, and the heat which the heat generation member generates due to the eddy current loss is used for fixing a developer image onto a recording medium.

2. Description of the Related Art

A fixing unit adapted for an image forming apparatus using digital technology, namely, an electronic copying machine, is in practical use. The fixing unit is provided with a heating roller, and a pressing roller which is in contact with the heating roller. A sheet is fed, sandwiched between these rollers. Meanwhile, the heat from the heating roller fixes a developer image onto the sheet.

An induction heating device is an example of a heat source of the heating roller. The induction heating device comprises a coil provided inside the heating roller, and a high-frequency generation circuit that supplies a high-frequency current to the coil.

The high-frequency generation circuit includes a rectifying circuit for rectifying a voltage provided by an AC voltage source, and a switching circuit for converting the output voltage (D.C. voltage) of the rectifying circuit into a high-frequency wave of a predetermined frequency. The coil described above is connected to the output terminal of the high-frequency generation circuit (i.e., to the output terminal of the switching circuit).

When the high-frequency generation circuit operates, the coil is supplied with a high-frequency current and thus generates a high-frequency magnetic field. This high-frequency magnetic field is applied to the heating roller, producing an eddy current in the heating roller. The heating roller generates heat due to the eddy current loss, and the heat serves to fix a developer image onto a sheet.

In this type of apparatus, the heating roller is kept at a predetermined temperature (a temperature that enables a fixing operation) by the temperature control of the main body of the copying machine.

In the apparatus, a driving signal with which to drive the high-frequency generation circuit is monitored in relation to time. Based on this monitoring, the heating roller is prevented from being heated to more than a predetermined temperature, and the fixing unit and the copying machine are thus prevented from igniting.

The monitoring based on time is executed at predetermined intervals. That is, it is executed without reference to changes in the environments in which the apparatus is installed, such as a change in temperature. Hence, the time-based monitoring of a driving signal, with which to drive the high-frequency circuit, is not properly executed in accordance with the conditions.

BRIEF SUMMARY OF THE INVENTION

The present invention relates to an image forming apparatus comprising a fixing unit which is provided with an induction heating apparatus wherein an eddy current is generated in a heating roller by the generation of a high-frequency magnetic field from a coil and a heating roller generates heat due to the eddy current loss, and which uses the heat generated by the heating roller to fix a developer image onto a recording medium. The object of the invention is to enable the image forming apparatus to execute processing in accordance with the environments.

The image forming apparatus of the present invention is of a type including a fixing unit that fixes a developer image onto a recording medium by utilization of the heat generation by the heating roller. The image forming apparatus comprises: a sensing section that senses a temperature of the heating roller; an output section that outputs a driving signal on the basis of the temperature sensed by the sensing section; an induction heating device including: a coil that is received inside the heating roller; a high-frequency generation circuit that supplies a high-frequency current to the coil; a control element that outputs a control signal to the high-frequency generation circuit on the basis of the driving signal output from the output section and that monitors a successive output time of the driving signal from the output section at different points of time corresponding to different environments; and processing means for supplying the high-frequency current provided by the high-frequency generation circuit to the coil based on the control signal from the control element, the induction heating device producing an eddy current in the heating roller by causing the coil to generate a high-frequency magnetic field, and causing the heating roller to generate heat based on an eddy current loss.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 3 shows an example of a manner in which a power setting table is stored.

DETAILED DESCRIPTION OF THE INVENTION

An embodiment of the present invention will now be described with reference to the accompanying drawings.

Figure 1:
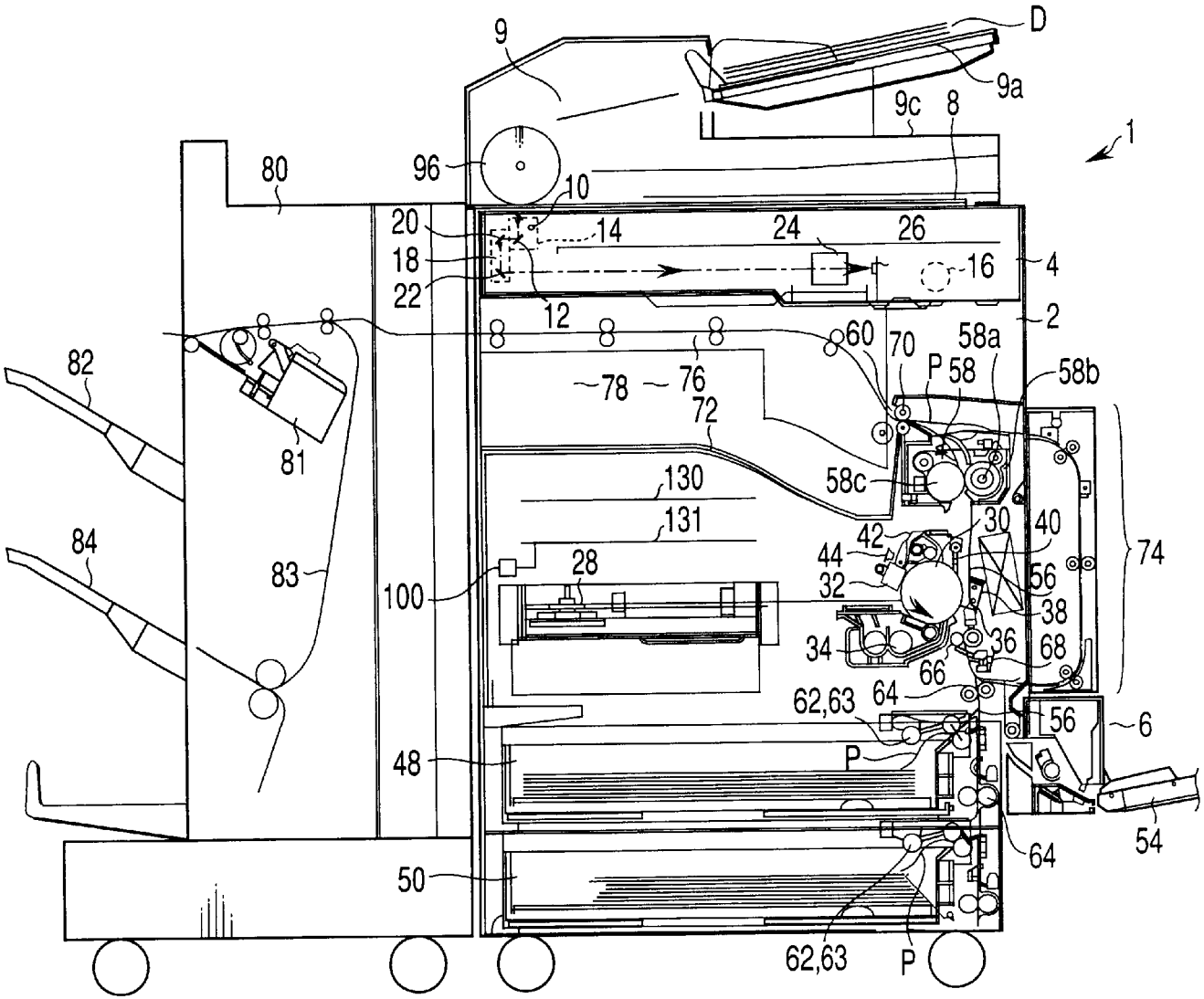
FIG. 1 is a schematic diagram of a digital copying machine, which is intended for illustrating an embodiment of the present invention.

FIG. 1 is a sectional view showing a schematic structure of a digital copying machine 1, which is an embodiment of the image forming apparatus of the present invention.

As shown in FIG. 1, the digital copying machine 1 is provided with an apparatus main body 2. Arranged inside of this apparatus main body are: a scanner section 4 serving as reading means, and a printer section 6 functioning as image formation means.

A document table 8, which is a transparent glass member and on which an object to be read (i.e., a document D) is placed, is the top portion of the apparatus main body 2. An automatic document feeder 9 (hereinafter referred to as an ADF), which serves as feeding means for automatically feeding documents D to the document table 8, is provided on the top surface of the apparatus main body 2.

A document D placed on the document tray 9*a* of the ADF 9 is fed by a feeding guide (not shown) and is then discharged onto a discharge tray 9*c* by means of a platen roller 9*b*. When the document D is being fed by the platen roller 9*b*, it is exposed to light emitted by the exposure lamp 10 of a scanner section 4 (described later). As a result, an image on the document D is read.

Documents D are set on the document tray 9*a* of the ADF 9*b* in such a manner that the surfaces to be read are turned up. The documents D are sequentially fed one by one, with the uppermost one taken first of all.

The scanner section 4, arranged inside the apparatus main body 2, includes an exposure lamp 10. This exposure lamp 10 serves as a light source for illuminating a document D, which is either fed by the ADF 9 or placed on the document table 8. The exposure lamp 10 is made of a halogen lamp 1, for example. The scanner section 4 also includes a first mirror 12 for deflecting the reflected light of the document D in a predetermined direction. The exposure lamp 10 and the first mirror 12 are mounted on a first carriage 14 located beneath the document table 8.

The first carriage 14 is movable in parallel to the document table 8. It is moved back and forth in the region under the document table 8 by a toothed belt (not shown) driven by a scanner motor (a driving motor) 16. The scanner motor 16 is a stepping motor, for example.

In the region under the document table 8, a second carriage 18 is arranged in such a manner that it is movable in parallel to the document table 8. A second mirror 20 and a third mirror 22, which deflect the reflected light deflected by the first mirror 12, are fixed to the second carriage 18 in such a manner that they are perpendicular to each other. A torque from the scanner motor 16 is transmitted to the second carriage 18 by the same toothed belt that drives the first carriage 14. The second carriage 18 moves along the document table 8 in such a manner as to follow the first carriage 14 at a speed half that of the first carriage 14.

In the region under the document table 8, an image formation lens 24 and a CCD sensor (line sensor) 26 are arranged. The image formation lens 24 converges the reflected light guided from the third mirror on the second carriage 18. The CCD sensor 26 receives the reflected light converged by the image formation lens 24 and performs photoelectric conversion of it. The image formation lens 24 is arranged in the plane containing the optical axis of the light deflected by the third mirror 22, and is movable in that plane by a driving mechanism. The movement of the image formation lens 24 allows the reflected light to be focused with a desired magnification (in the main scanning direction). The CCD sensor 26 performs photoelectric conversion of the reflected light that is incident thereon in accordance with image processing clocks provided by a main CPU (to be described later). By this photoelectric conversion, the CCD sensor outputs electric signals corresponding to the document D that has been read. The magnification in the sub-scanning direction can be adjusted by changing the feeding speed by the ADF 9 or the moving speed of the first carriage 14.

When a document D is read by use of the ADF 9, the irradiation position of the exposure lamp 10 is fixed at a read position (not shown). When the document D placed on the document table 8 is read, the irradiation position of the exposure lamp 10 moves from left to right along the document table 8.

The printer section 6 is provided with a laser exposure device 28 functioning as latent image forming means. A laser beam emitted from the laser exposure device 28 is scanned across the circumferential surface of the photosensitive drum 30, as a result of which an electrostatic latent image is formed on the circumferential surface of the photosensitive drum 30.

The printer section 6 includes the photosensitive drum 30. This photosensitive drum 30 is a rotatable drum serving as an image bearer and located to the right of the substantial center of the apparatus main body 2. The circumferential surface of the photosensitive drum 30 is exposed to a laser beam emitted from the laser exposure device 28, and a desired electrostatic latent image is formed thereby. Arranged around the photosensitive drum 30 are: an electric charger 32 for electrically charging the drum circumference to have a predetermined charge level; a developing unit 34 which serves as developing means for supplying toner (i.e., developer) to the electrostatic latent image formed on the circumference of the photosensitive drum 30 so as to develop the electrostatic latent image with a desired image density; and a separation charger 36 for separating image formation mediums (i.e., copying sheets P) fed from cassettes 48 and 50 (to be described later) from the photosensitive drum 30. The electric charger 32, the developing unit 34 and the separation charger 36 are assembled as one body. Also arranged around the photosensitive are: a transfer charger 36 for transferring a toner image from the photosensitive drum 30 onto a sheet P; a separation claw 40 for separating a copying sheet P from the circumferential surface of the photosensitive drum 30; a cleaning device 42 for cleaning residual toner from the circumferential surface of the photosensitive drum 30; and an electric charger for removing electricity from the circumferential surface of the photosensitive drum 30. These structural components are arranged in the order mentioned.

An upper cassette 48 and a lower cassette 50 are located in the bottom portion of the apparatus main body 2. The upper and lower cassettes 48 and 50 are stacked one upon the other and can be pulled out of the apparatus main body 2. The cassettes 48 and 50 store copying sheets that are different in size. A manual insertion tray 54 is located on one side of the upper cassette 48.

A sheet feed path 56 is defined inside the apparatus main body 2. The sheet feed path 56 extends from the cassettes 48 and 50 and passes through a transfer section located between the photosensitive drum 30 and the transfer charger 38. A fixing unit 58 is located at the terminating end of the sheet feed path 56. A discharge port 60 is formed above the fixing unit 58.

The fixing unit 58 comprises a heating roller 58*b* containing an induction heating device (IH) 58*a,* which serves as a heat source. The fixing unit 58 also comprises a pressing roller 58*c*. A copying sheet P is made to pass through the region between the heating roller 58*b* and the pressing roller 58*c,* and the heat of the pressing roller 58*b* serves to fix a developer image on the copying sheet P. After passing through the fixing unit 58, the copying sheet P is discharged from the discharge port 60 by means of a pair of sheet discharge rollers 70.

A sheet feed roller 62 and a separation roller 63 are arranged in the neighborhood of each of the upper and lower cassettes 48 and 50. By means of these rollers 62 and 63, the sheets P are taken out of the cassettes 48 and 50 one by one. A large number of sheet feed roller pairs are arranged in the sheet feed path 56 so that the copying sheets P taken out by the sheet feed rollers 62 and the separation rollers 63 can be guided along the sheet feed path 56.

In the sheet feed path 56, a pair of register rollers 66 are arranged at a position upstream of the photosensitive drum 30. By these register rollers, a skew of a taken-out copying sheet P is corrected, and the start position of a toner image on the photosensitive drum 30 is matched with the leading end of is the copying sheet P. Further, the copying sheet P is conveyed to the transfer section at the same speed as the moving speed of the circumference of the photosensitive drum 30. At a position before the register rollers 66 (at a position closer to sheet feed rollers 64), a pre-aligning sensor 68 is arranged to detect the arrival of the copying sheet P.

The copying sheets P, taken out from the cassettes 48 and 50 one by one by means of the sheet feed rollers 62, are guided to the register rollers 66 by the paired sheet feed rollers 64. After the leading ends are lined up by the register rollers 66, the copying sheets P are conveyed to the transfer section.

In the transfer section, a developer image formed on the photosensitive drum 30 (that is, a toner image) is transferred onto a sheet P by the transfer charger 38. The copying sheet P, on which the toner image has been transferred, is separated from the circumferential surface of the photosensitive drum 30 by the separation charger 36 and the separation claw 40. The copying sheet P is then conveyed to the fixing unit 58 by means of a conveyance belt (not shown), which defines part of the sheet feed path 56. After the developer image is melted and fixed onto the copying sheet P by the fixing unit 58, the copying sheet P passes through the discharge port, and is then discharged onto a sheet discharge tray 72 inside the apparatus main body 2 by the sheet discharge rollers 70.

An automatic reversing device 74 is located to the right of the sheet feed path 56. The automatic reversing device 74 reverses a copying sheet P which has passed through the fixing unit 58 and then returns it into the sheet feed path 56.

A control panel is provided on top of the front portion of the apparatus main body 2. By operating the control panel, various copying conditions, including a copying magnification, are entered, and the start of a copying operation is designated.

A main body circuit board 130 and an induction heating device circuit board 131 are arranged inside the apparatus main body 2. A temperature sensor 100, which detects the temperature of an installation site as an environmental temperature, is connected to the induction heating device circuit board 131. The temperature sensor 100 is located on one side of the apparatus main body 2 and detects a temperature there.

The digital copying machine 1 described above may be provided with optional functions (devices), including an ADF function, a finisher function, a FAX function, a printer function, a DSS (double-sided) function, etc. The ADF function enables in-advance input, which executes only a read operation in advance. An ADF (the automatic document feeder 9) is provided on the document table and connected to the main body.

The finisher function is provided on one side of the apparatus main body and is connected to the main body.

The FAX function is added by mounting a FAX board on the motherboard of a control circuit.

The printer function is added by mounting a printer FAX board on the motherboard of the control circuit.

The DSS (double-sided) function is provided by adding a DSS controller to the control circuit.

The functions described above may be made available by setting a memory, a hard disk or the like at the time of function addition. Alternatively, the connection (setting) states of options are determined by sending an inquiry to the sections and receiving responses from them, or by checking the states of the switches of the board.

Figure 2:
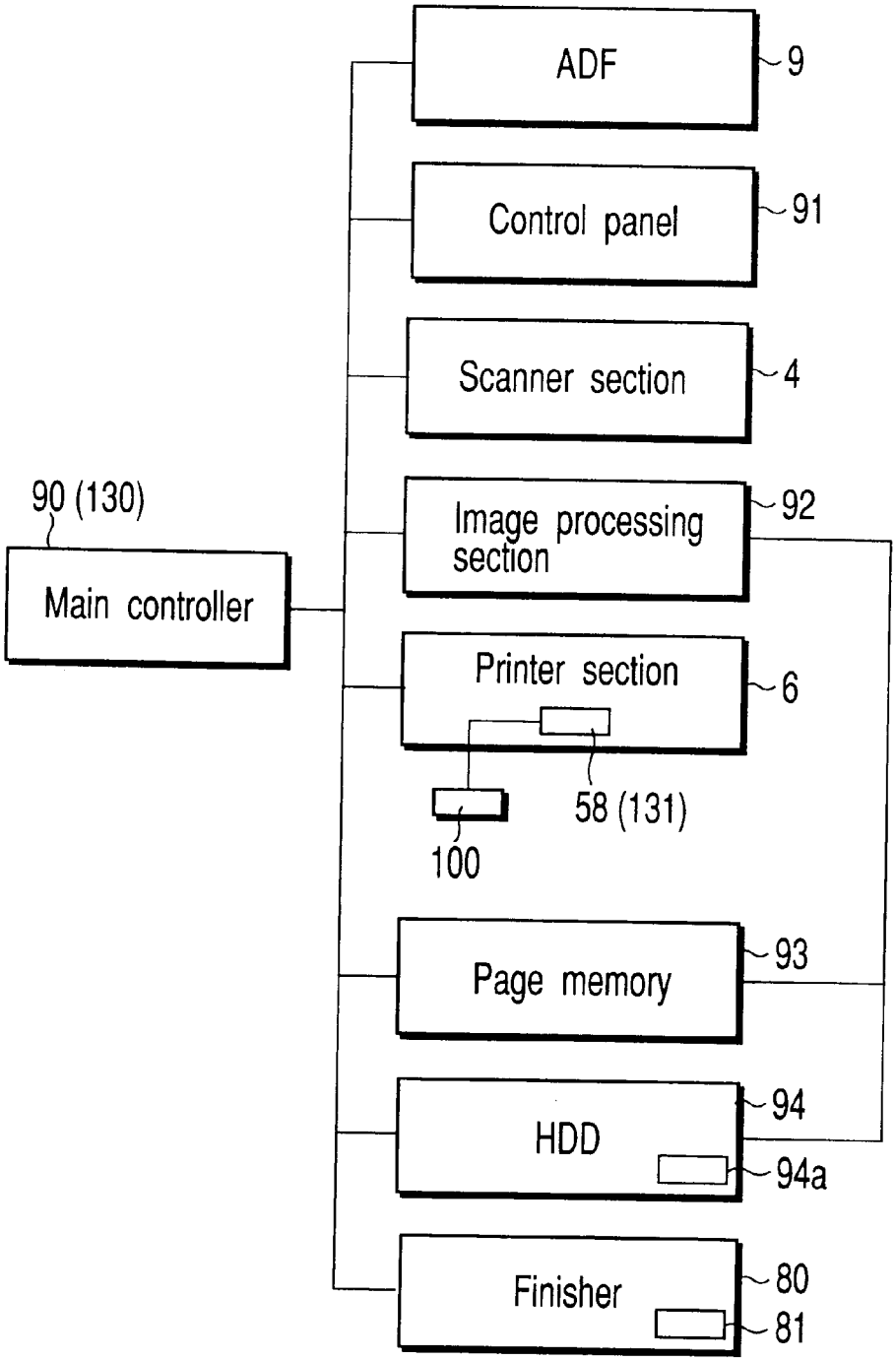
FIG. 2 is a block diagram illustrating an internal structure of a control circuit of the digital copying machine.

The internal structure of the control circuit of the digital copying machine 1 will be described with reference to FIG. 2.

The digital copying machine 1 is provided with a main controller 90 that performs overall control. Although not shown, the main controller 90 is provided with: a CPU (central processing unit) for controlling the operation thereof; a ROM (Rend only memory) for storing operation software of the digital copying machine 1; and a RAM (random access memory) (S-RAM) for temporarily storing image data or other operation data.

To the main controller 90, the following are connected: the ADF 9, the scanner section 4, the printer section 6, the control panel 91, an image processing section 92, a page memory 93, and an HDD 94. These structural elements are connected through a bus 95. The image processing section 92, page memory 93 and HDD 94 are connected through an image bus 96.

The control panel 91 is provided on top of the front portion of the apparatus main body 2. By operating the control panel, various copying conditions, including a copying magnification, are entered, and the start of a copying operation is designated.

The image processing section 92 processes an image document read by the scanner section 4, processes image data supplied thereto from the page memory 93 and HDD 94, and outputs the processed image data to the page memory 93 and the printer section 6 or to the HDD 94.

The image processing section 92 comprises a compression/expansion circuit (not shown). By use of this compression/expansion circuit, the image processing section 92 compresses the image data from the page memory 93 or expands the image data supplied from the HDD 94.

The page memory 93 registers the image data supplied from the image processing section 92.

The HDD 94 is an external storage section. Typically, it is a hard disk that stores various kinds of data. For example, when a number of copies are made, read images corresponding to plural-page document images are compressed, for registration. At the time of printing, the compressed images are read out and printed.

A power setting table 94*a* is stored in the HDD 94 beforehand.

As shown in FIG. 3, the power setting table 94*a* holds data on the amount of power the induction heating device (IH) 58*a* applies to a coil 105 during the warming-up processing (WUP) executed when the power is turned on, and data on the amount of power the induction heating device (IH) 58*a* applies to the coil 105 during the subsequent pre-run processing. These two kinds of data are held in relation to the various connection states of the options (○: a connected state, X: a disconnected state).

There are four states in each of the warming-up processing and the pre-run processing.

The four states are the following: when the in-advance input is executed by the ADF 9 (RADF); when the in-advance input (SCN) is executed based on the driving of the scanner section 4 (the movement of the first carriage 14); when both the scanner section 4 and the ADF 9 are being initialized (only the scanner section 4 is initialized if the ADF 9 is not connected) (INI); and no particular operation is performed (–).

By way of example, let us consider the case where only the ADF 9 is connected as an option. In this case, the warming-up processing is executed in such a manner that power "1250 W" is set in the state where the in-advance input is executed by the ADF 9 and power "1300 W" is set in the other states. The pre-run processing is executed in such a manner that power "1200 W" is set in the state where the in-advance input is executed by the ADF 9 and power "1250 W" is set in the other states.

The amount of power the induction heating device (IH) 58*a* applies to the coil 105 is set at "700 W" in the "ready mode", and at "900 W" in the "print mode."

The main controller 90 is provided with input tasks and print tasks that are managed for each job.

Figure 4:
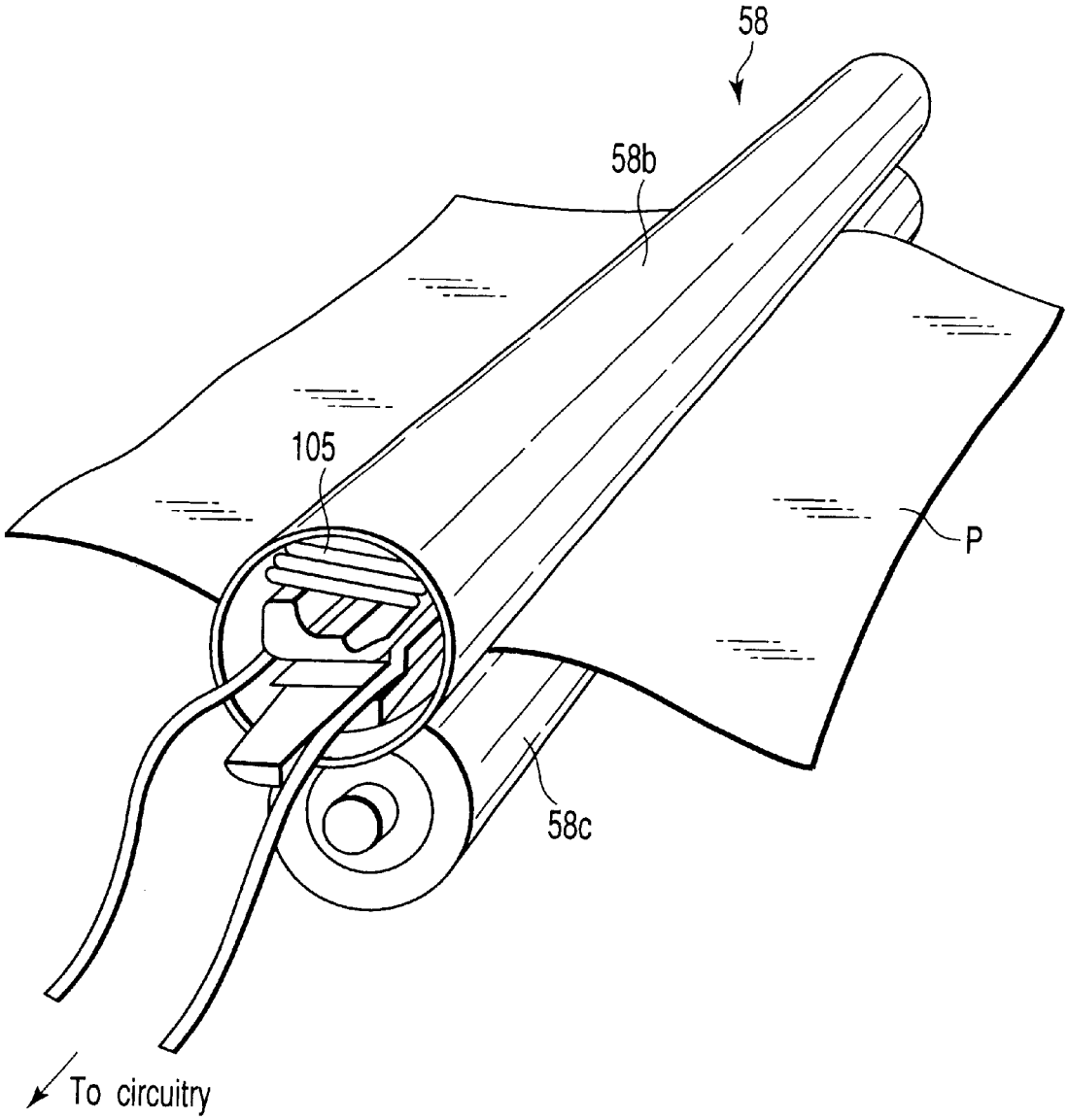
FIG. 4 is a schematic perspective view illustrating the shape of a coil assembled in a fixing unit.
Figure 5:
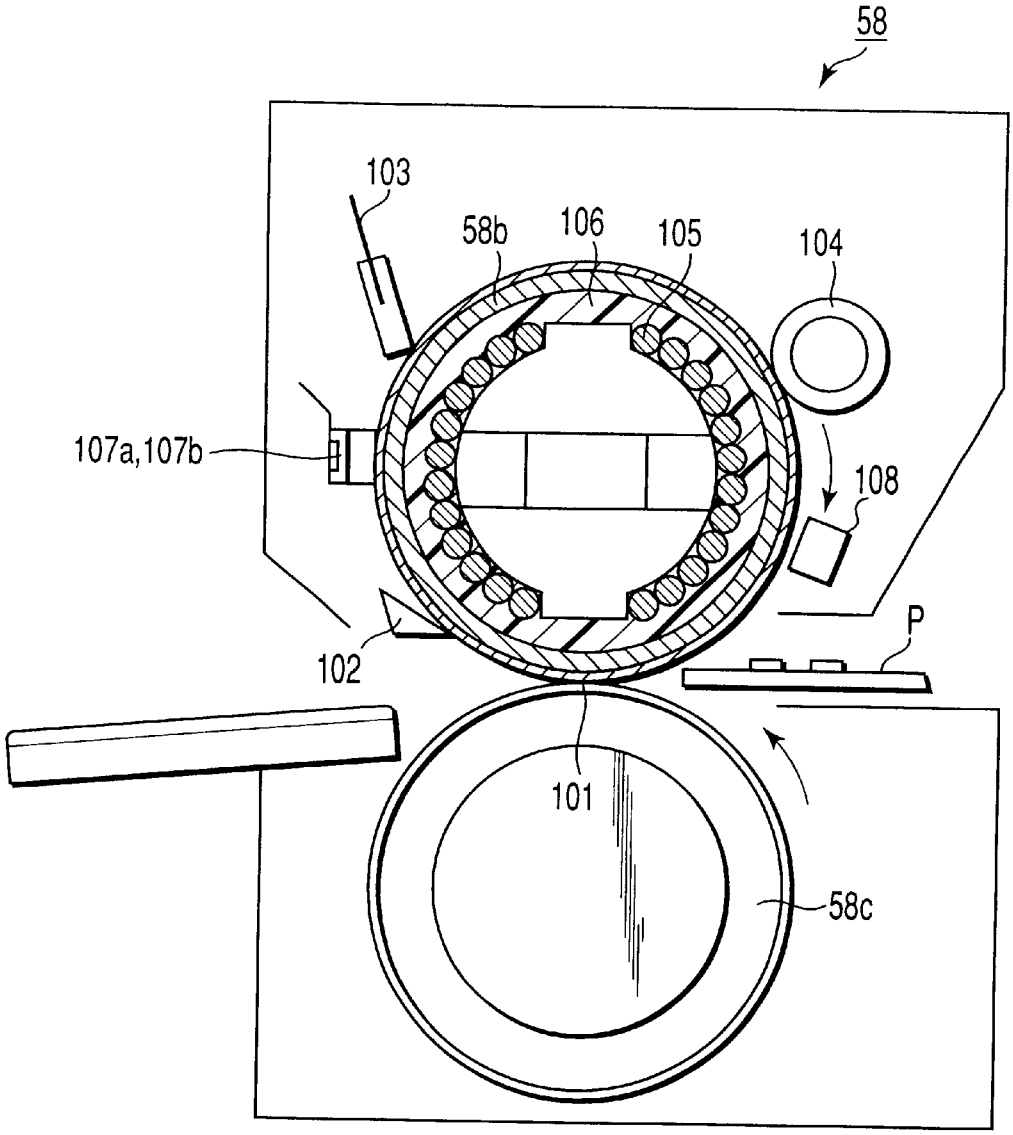
FIG. 5 is a view showing the major portion of the fixing unit.

FIG. 4 is a schematic perspective view showing the shape of a coil incorporated into the fixing unit 58. FIG. 5 shows the major portion of the fixing unit.

As shown in FIGS. 4 and 5, the fixing unit 58 comprises a heating (fixing) roller 58*b* and a pressing (press) roller 58*c*.

The heating roller 58*b* is driven in the arrow direction by a driving motor (not shown). Moved by the heating roller 58*b*, the pressing roller 58*c* rotates in the arrow direction. A sheet P, which is a material bearing a toner image T to be fixed, is made to pass through the region between the two rollers.

The heating roller 58*b* is an endless member comprising a 1 mm-thick iron cylinder (a conductor or a metallic layer). A separation layer formed of Teflon is formed on the surface of the heating roller. The heating roller 58*b* need not be made of iron; it may be a stainless steel, aluminum, an alloy of the two, or the like.

The pressing roller 58*c* comprises a core member and an elastic member coated over the core member. The elastic member is made of silicone rubber or fluorine plastic, for example. The pressing roller 58*c* is pressed against the heating roller 58*b* with predetermined pressure by means of a pressing mechanism. As a result, a nip 101 of a predetermined width is provided at the position where two rollers are in contact (the nip is produced by elastic deformation of the outer circumference of the pressing roller 58*c*).

When a sheet P passes through the nip 101, the toner on the sheet P is melted and fixed on the sheet P.

At positions on the circumference of the heating roller 58*b* and downstream of the nip 101 with respect to the rotating direction, the following are provided: a separation claw 102 that separates a sheet P from the heating roller 58*b*; a cleaning member 103 that cleans the outer circumference of the heating roller 58*b* by removing the toner that has been offset transferred or paper particles produced from the sheet; a releasing agent-coating device 104 that coats a releasing agent over the outer circumference of the heating roller 58*b* to prevent adhesion of toner; thermistors 107*a* and 107*b* that are used for detecting the temperature of the outer circumference of the heating roller 58*b*; and a thermostat 108 whose contact is set in the open state when the temperature becomes higher than the predetermined value, thereby stopping the supply of power voltage.

An excitation coil 105 is arranged inside the heating roller 58*b*. The excitation coil 105 is made up of Litz wires. The Litz wires are, for example, copper wires with a diameter of 0.5 mm and are bundled together in such a manner as to form a magnetic field generating means. Since the excitation coil is made of Litz wires, the wire diameter is less than the penetration depth, so that a high-frequency current is allowed to flow efficiently. In the embodiment shown in FIG. 5, the excitation coil 105 is made of a bundle of 19 wires which are coated with heat-resistant polyamide and which have a diameter of 0.5 mm.

The excitation coil 105 is a hollow coil which does not employ a core member (e.g., a ferrite or iron core). Since the excitation coil 105 is a hollow coil, a core member, which is complicated in shape, is not needed, resulting in a decrease in the cost. In addition, an excitation circuit can be manufactured at low cost.

The excitation coil 106 is supported by a coil support member 106 formed of heat-resistant resin (e.g., a heat-resistant plastic material for industrial use).

The coil support member 106 is positioned between structural elements (plates) (not shown) that hold the heating roller.

The excitation coil 105 provides the heating roller 58*b* for a magnetic flux and an eddy current so that the magnetic flux produced by the high-frequency current supplied from an excitation circuit (an inverter circuit) (not shown) prevents a change in the magnetic field. The eddy current and the resistance of the heating roller 58*b* produce Joule heat, which heats the heating roller 58*b*. In the present embodiment, the excitation coil 105 is supplied with a high-frequency current 900 W whose frequency is 25 kHz.

Figure 6:
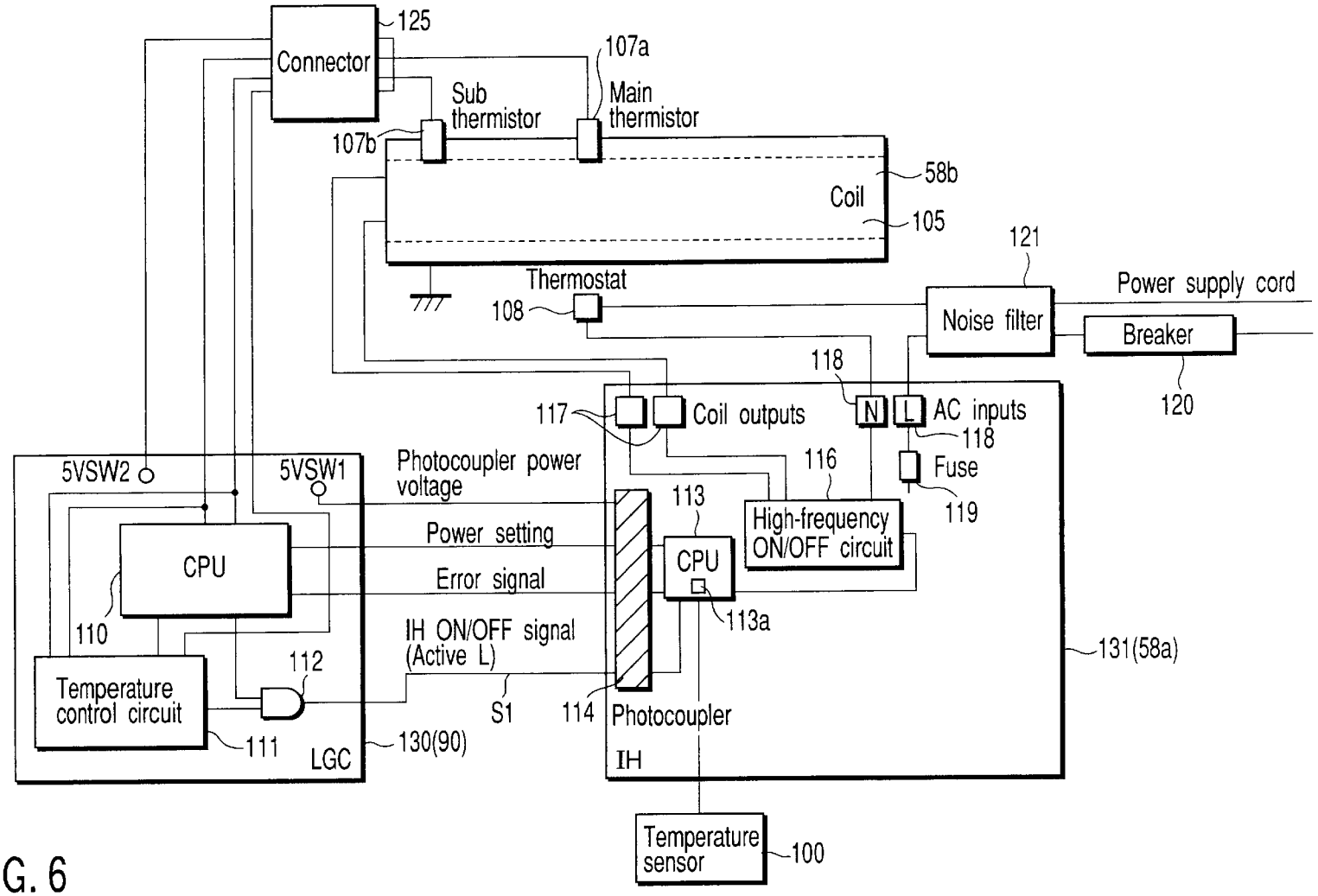
FIG. 6 shows the major portion of a control circuit used for a heating roller.

A control circuit of a major section for controlling the heating roller 58*b* will be described with reference to FIG. 6.

The control circuit comprises the main body circuit board 130 of (the fixing unit of) the main controller 90 (or the board used for the fixing unit) and the induction heating device circuit board 131 (used for the induction heating device [IH] 58*a*).

Arranged on the main body circuit board 130 are: a CPU 110 (i.e., a control element), a temperature control circuit 111, an AND (logical product) circuit 112, and switches SW1 and SW2 used for the supply of power voltage.

On the basis of a control signal from the CPU 110 and the temperature of the heating roller 58*b*, the temperature control circuit 111 outputs an IH ON signal and supplies it to the AND circuit 112. The temperature control circuit 111 receives sensing signals which are supplied thereto from the thermistors 107*a* and 107*b* by way of a connector 125 outside the circuit board 130. The temperature control circuit 111 also receives a control signal supplied from the CPU 110 and representing the present operating state.

The CPU 110 supplies a power setting signal based on the present operating state to the induction heating device 58*a*.

It also supplies a control signal based on the present operating state to the temperature control circuit 111. Further, it supplies a permission signal to the AND circuit 112 on the basis of the presence/absence of an error signal from the induction heating device 58*a,* the temperature of the heating roller 58*b,* etc. The CPU 110 receives sensing signals which are supplied thereto from the thermistors 107*a* and 107*b* by way of the connector 125 outside the circuit board 130, and also receives an error signal from the induction heating device 58*a.*

When the permission signal from the CPU 110 is supplied, the AND circuit 112 supplies the IH ON signal received from the temperature control circuit 111 to the induction heating device 58*a.*

The switch SW1 is connected through a signal line to a photocoupler 114 described later. From the switch SW1, a power voltage is applied to the photocoupler 114.

The switch SW2 is connected through a signal line to the connector 125. From the switch SW2, a power voltage is applied to the connector 125.

Arranged on the induction heating device circuit board 131 are: a CPU 113 (i.e., a control element), the photocoupler 114 mentioned above, a high-frequency ON/OFF circuit 116 (which is a high-frequency generating circuit), output ports 117, 117, input ports 118, 118, and a fuse 119.

The photocoupler 114 enables signal exchange (transmission and reception) in a non-contact manner. The photocoupler 114 receives a photocoupler power voltage of 5V from the switch SW1 of the circuit board 130, also receives a power setting signal from the CPU 110 of the circuit board 130 through the signal line, and further receives an IH ON signal from the AND circuit 112 of the circuit board 130 through the signal line S1. The photocoupler 114 outputs an error signal from the CPU 113 to the CPU 110 of the circuit board 130 by way of a signal line.

The photocoupler 114 outputs the power setting signal it receives to the CPU 113 in a non-contact manner. Likewise, it outputs the IH ON signal to the CPU 113 in a non-contact manner.

The CPU 113 controls the driving of the high-frequency ON/OFF circuit 116. More specifically, it controls the driving of the high-frequency ON/OFF circuit 116 on the basis of the power setting signal it receives. In addition, it determines a variety of errors and outputs error signals based on the determination.

The CPU 113 outputs an IH ON signal it receives from the photocoupler 114 when an error or the like is not generated, and outputs that IH ON signal to the high-frequency ON/OFF circuit 116.

In a warming-up mode, the CPU 113 compares the successive supply time of the IH ON signal supplied from the photocoupler 114 with an error sensing time read out from the internal memory 113*a* (i.e., the time needed for determining a temperature higher than a read temperature). When the successive supply time of the IH ON signal becomes longer than the error sensing time, the CPU 113 determines that the temperature at the time is higher than the ready temperature. In this case, the CPU 113 stops outputting the IH ON signal to the high-frequency ON/OFF circuit, thereby preventing the heating roller 58*b* from overheating or igniting.

The error sensing time is dependent on the room temperature. For example, the error sensing time is 30 seconds when the room temperature is 30°, and is 90 seconds when it is 0°. Data on these relationships is stored in the internal memory 113*a.*

In the pre-run mode, ready mode and print mode as well, the CPU 113 may check the successive ON time of the IH ON signal on the basis of the error sensing time which varies in accordance with the room temperature.

When the IH ON signal from the CPU 113 is supplied, the high-frequency ON/OFF circuit 116 applies the power determined by the CPU 113 to the coil 105 by use of the output ports 117, 117.

When the coil 105 is supplied with a high-frequency current from the high-frequency ON/OFF circuit 116, the coil 105 generates a high-frequency magnetic field. This high-frequency magnetic field produces an eddy current in the heating roller 58*b.* Due to the eddy current loss dependent upon the eddy current and the resistance of the heating roller 58*b,* the heating roller 58*b* generates heat.

The input ports 118, 118 are applied with an AC power from an electrical outlet (not shown) through a breaker 120, a noise filter 121 and the thermostat 108. One of the input ports 118, 118 is provided with the fuse 119. The AC power provided from the input ports 118, 118 is applied to each of the structural components of the induction heating device circuit board 131.

Although illustration is omitted, the induction heating device circuit board 131 is provided with a rectifier circuit for rectifying the voltage of a commercial AC power supply, and a constant voltage circuit section for adjusting the output voltage of the rectifier circuit in accordance with the operation of the CPU 113 and outputting the resultant constant-level voltage.

[First Embodiment]

Figure 7:
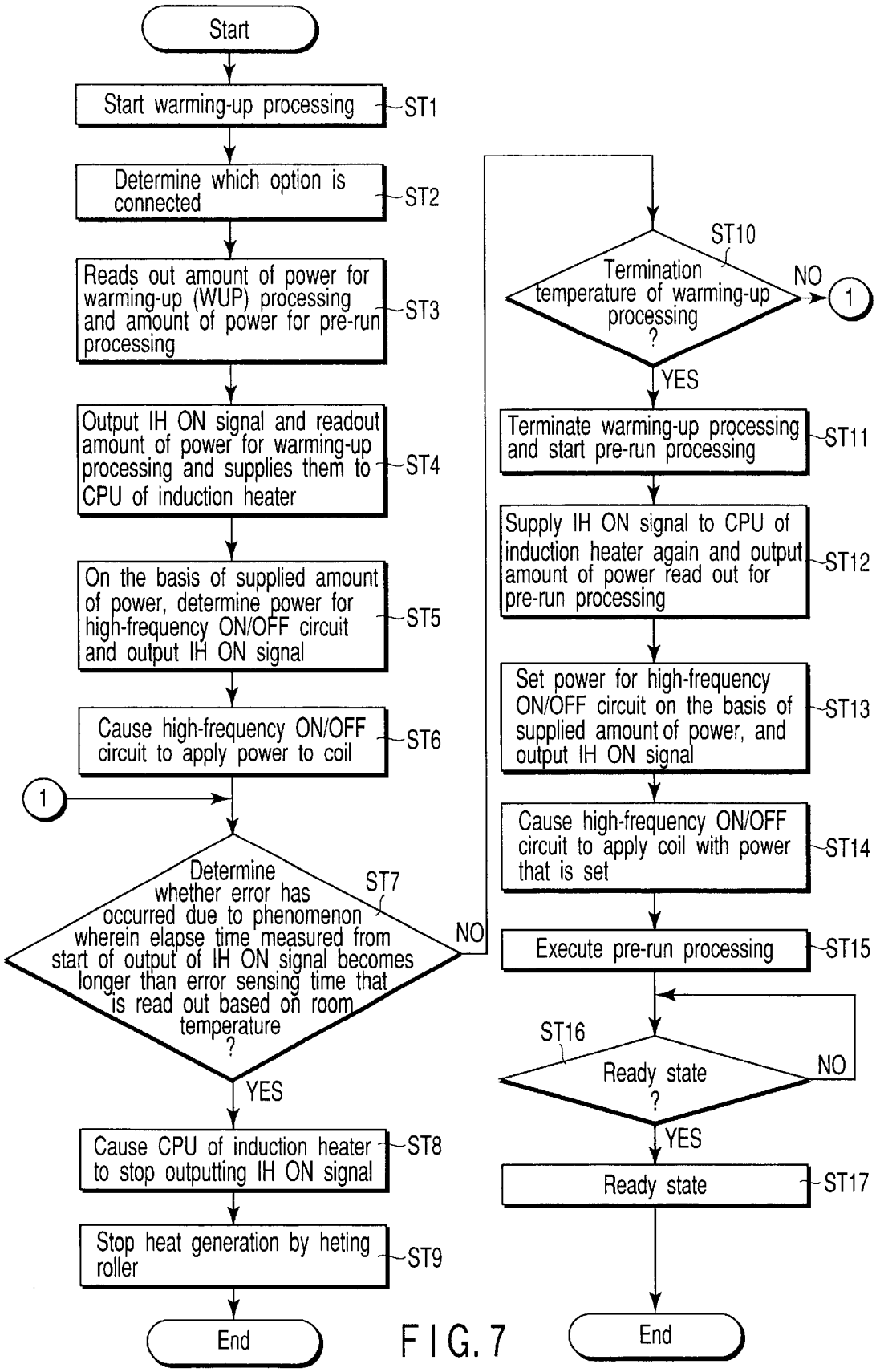
FIG. 7 is a flowchart illustrating warming-up processing and the error processing which the CPU of an induction heating apparatus executes during the warming-up processing.

How the above configuration operates will be described, referring to the case where the CPU 113 of the induction heating device 58*a* performs error processing in the warming-up mode. The description will be given with reference to FIG. 7.

When the power supply switch (not shown) is turned on, the CPU 110 of the main controller 90 determines the start of the warming-up processing (ST 1). Based on this determination, the CPU 110 makes inquiries to the connected devices and checks the states of the switches, thereby determining which option is connected (ST 2). Subsequently, on the basis of the options that have been determined as being connected, the CPU 110 searches the power setting table 94*a* and reads out the amount of power predetermined for the warming-up (WUP) processing and the amount of power predetermined for the pre-run processing (ST 3).

The CPU 110 outputs an IH ON signal and the readout amount of power (power setting) predetermined for the warming-up (WUP) processing and supplies them to the CPU 113 by way of the photocoupler 114 of the induction heating device 58*a* (ST 4).

On the basis of the supplied amount of power, the CPU 113 determines power for the high-frequency ON/OFF circuit 116, and supplies the IH ON signal it receives to the high-frequency ON/OFF circuit 116 (ST 5). While the CPU 113 supplies the IH ON signal, the high-frequency ON/OFF circuit 116 applies the power set by the CPU 113 to the coil through the output ports 117, 117 (ST 6).

Supplied with the high-frequency current from the high-frequency ON/OFF circuit 116, the coil 105 generates a high-frequency magnetic field. This high-frequency magnetic field causes an eddy current in the heating roller 58*b.* Due to the eddy current loss dependent upon the eddy current and the resistance of the heating roller 58*b,* the heating roller 58*b* generates heat.

In this state, the CPU 113 determines whether an error has occurred on the basis of an error sensing time and the elapse time measured from the start of output of the IH ON signal (ST 7). The error sensing time is read out from the internal memory 113*a* on the basis of the room temperature, which is a sensing temperature supplied from the temperature sensor 100. If the elapse time is longer than the error sensing time, the occurrence of an error is determined. In the case where the CPU 113 determines the occurrence of an error, the CPU 113 stops outputting the IH ON signal (ST 8). As a result, the induction heating device 58*a* stops supplying a high-frequency current to the coil 105, and the heat generation by the heating roller 58*b* stops (ST 9).

If the occurrence of the error is not determined, and the CPU 110 determines that the surface temperature of the heating roller 58*b* detected by the thermistors 107*a* and 107*b* has reached the termination temperature of the warming-up processing (ST 10), then the CPU 110 determines the termination of the warming-up processing and the start of the pre-run processing (ST 11). In this case, the CPU 110 temporarily stops outputting the IH ON signal to the CPU 113 and starts outputting an IH OFF signal.

Then, the CPU 110 supplies the IH ON signal to the CPU 110 again, and outputs the amount of power read out for the pre-run processing (ST 12).

In this manner, the CPU 113 sets power for the high-frequency OH/OFF circuit 116 on the basis of the amount of power it receives, and supplies the IH ON signal it receives to the high-frequency ON/OFF circuit 116 (ST 13). While the IH ON signal from the CPU 113 is kept supplied, the high-frequency ON/OFF circuit 116 applies the power set by the CPU 113 to the coil 105 through the output ports 117, 117 (ST 14).

Applied with the high-frequency current by the high-frequency ON/OFF circuit 116, the coil 105 generates a high-frequency magnetic field. This magnetic field produces an eddy current in the heating roller 58*b*. The heating roller 58*b* generates heat, due to the eddy current loss dependent upon the eddy current and the resistance of the heating roller 58*b*.

In this state, the CPU 110 rotates the heating roller 58*b* of the fixing unit 58 and pre-run processing is executed (ST 15), so that the overall surface temperature by the heating roller 58*b* is made uniform.

The CPU 110 determines the end of the pre-run processing (ST 16) and is set in the ready state (ST 17) when other kinds of initial processing have terminated.

As described above, the error sensing time, which is to be compared with the successive ON time of the IH ON signal in the warming-up processing, is controlled on the basis of the room temperature. To be more specific, the error sensing time is controlled to be short when the room temperature is high, and to be long when it is low. When the room temperature is high, the fixing unit 58, more specifically the surface of the heating roller 58*b*, easily rises in temperature. This is why the error sensing time is controlled to be short. On the other hand, when the room temperature is low, the fixing unit 58, more specifically the surface of the heating roller 58*b*, does not easily rise in temperature. This is why the error sensing time is controlled to be long.

In the pre-run mode, ready mode and print mode as well, the error sensing time, which is to be compared with the successive ON time of the IH ON signal, may be controlled on the basis of the room temperature, as in the warming-up processing described above. With the error sensing time controlled in this manner, the CPU 113 executes an error sensing operation.

[Second Embodiment]

In the first embodiment described above, reference was made to the case where the error sensing time was varied in accordance with the room temperature. This, however, does not limit the present invention. In the second embodiment, the error sensing time is varied on the basis of the amount of power consumed in the warming-up (WUP) processing, which is dependent on the option-connected state.

In the case of this embodiment, the internal memory 113*a* registers an error sensing time (i.e., the time used for determining a temperature higher than the ready temperature) which is based on the power amount (power setting). The error sensing time is lengthened in accordance with a decrease in the power. For example, the error sensing time is set at 30 seconds when the power setting is 1,300 W, at 35 seconds when it is 1,250 W, at 40 seconds when it is 1,200 W, and at 45 seconds when it is 1,100 W. In this manner, the power setting is proportional to the time used for determining a temperature higher than the ready temperature.

Figure 8:
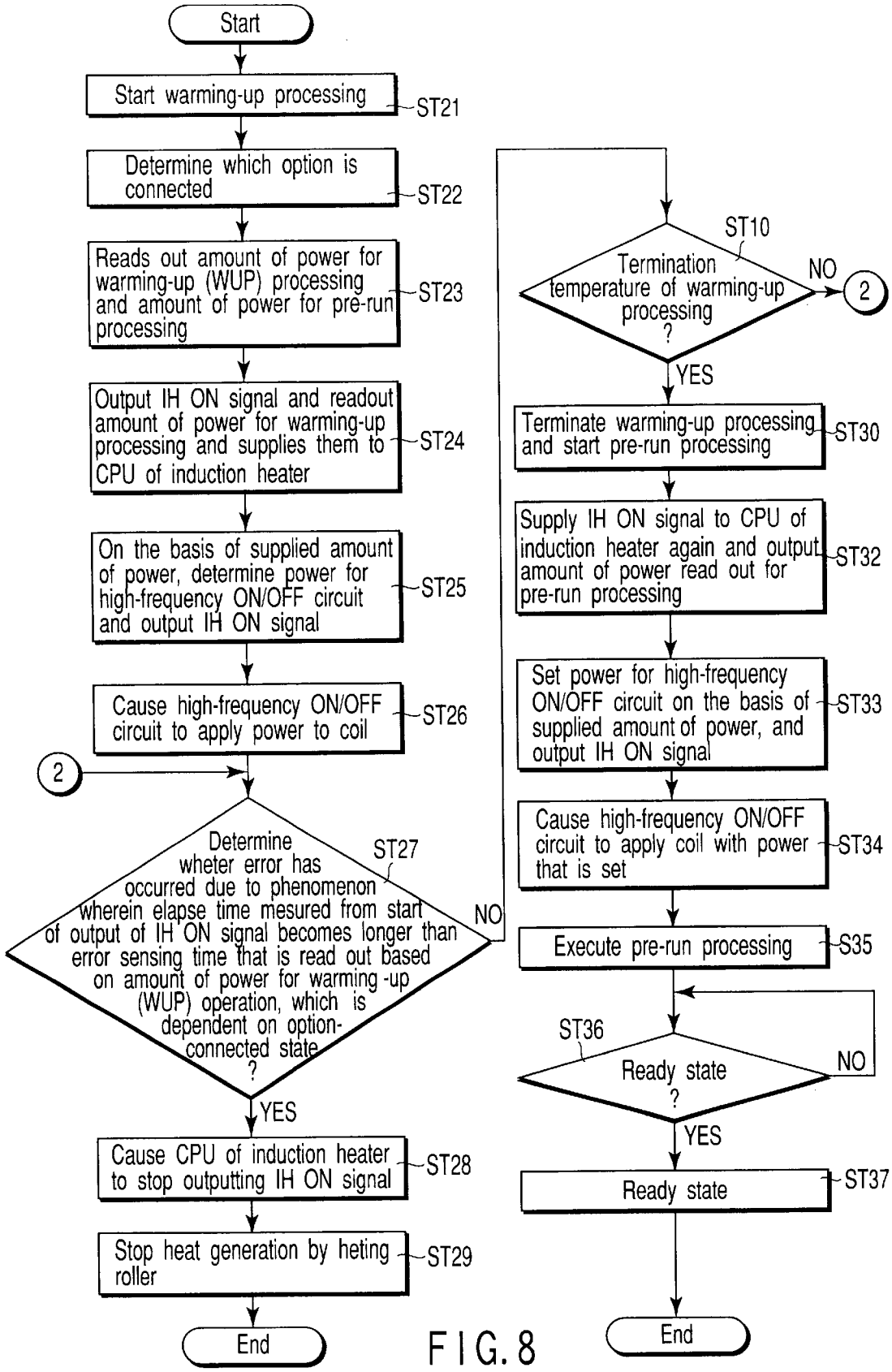
FIG. 8 is also a flowchart illustrating the warming-up processing and the error processing which the CPU of an induction heating apparatus executes during the warming-up processing.

How the above configuration operates will be described, referring to the case where the CPU 113 of the induction heating device 58*a* performs error processing in the warming-up mode. The description will be given with reference to FIG. 8.

When the power supply switch (not shown) is turned on, the CPU 110 of the main controller 90 determines the start of the warming-up processing (ST 21). Based on this determination, the CPU 110 makes inquiries to the connected devices and checks the states of the switches, thereby determining which option is connected (ST 22). Subsequently, on the basis of the options that have been determined as being connected, the CPU 110 searches the power setting table 94*a* and reads out the amount of power predetermined for the warming-up (WUP) processing and the amount of power predetermined for the pre-run processing (ST 23).

The CPU 110 outputs an IH ON signal and the readout amount of power (power setting) predetermined for the warming-up (WUP) processing and supplies them to the CPU 113 by way of the photocoupler 114 of the induction heating device 58*a* (ST 24).

On the basis of the supplied amount of power, the CPU 113 determines power for the high-frequency ON/OFF circuit 116, and supplies the IH ON signal it receives to the high-frequency ON/OFF circuit 116 (ST 25). While the CPU 113 supplies the IH ON signal, the high-frequency ON/OFF circuit 116 applies the power set by the CPU 113 to the coil through the output ports 117, 117 (ST 26).

Supplied with the high-frequency current from the high-frequency ON/OFF circuit 116, the coil 105 generates a high-frequency magnetic field. This high-frequency magnetic field causes an eddy current in the heating roller 58*b*. Due to the eddy current loss dependent upon the eddy current and the resistance of the heating roller 58*b*, the heating roller 58*b* generates heat.

In this state, the CPU 113 determines whether an error has occurred on the basis of an error sensing time and the elapse time measured from the start of output of the IH ON signal (ST 27). The error sensing time is read out from the internal memory 113*a* on the basis of the amount of power used for the warming-up (WUP) processing, which is dependent upon the option-connected state. If the elapse time is longer than the error sensing time, the occurrence of an error is determined. In the case where the CPU 113 determines the occurrence of an error, the CPU 113 stops outputting the IH ON signal (ST 28). As a result, the induction heating device 58*a* stops supplying a high-frequency current to the coil 105, and the heat generation by the heating roller 58*b* stops (ST 29).

If the occurrence of the error is not determined, and the CPU 110 determines that the surface temperature of the heating roller 58*b* detected by the thermistors 107*a* and 107*b* has reached the termination temperature of the warming-up processing (ST 30), then the CPU 110 determines the termination of the warming-up processing and the start of the pre-run processing (ST 31). In this case, the CPU 110 temporarily stops outputting the IH ON signal to the CPU 113 and starts outputting an IH OFF signal.

Then, the CPU 110 supplies the IH ON signal to the CPU 110 again, and outputs the amount of power read out for the pre-run processing (ST 32).

In this manner, the CPU 113 sets power for the high-frequency OH/OFF circuit 116 on the basis of the amount of power it receives, and supplies the IH ON signal it receives to the high-frequency ON/OFF circuit 116 (ST 33). While the IH ON signal from the CPU 113 is kept supplied, the high-frequency ONIOFF circuit 116 applies the power set by the CPU 113 to the coil 105 through the output ports 117, 117 (ST 34).

Applied with the high-frequency current by the high-frequency ON/OFF circuit 116, the coil 105 generates a high-frequency magnetic field. This magnetic field produces an eddy current in the heating roller 58*b*. The heating roller 58*b* generates heat, due to the eddy current loss dependent upon the eddy current and the resistance of the heating roller 58*b*.

In this state, the CPU 110 rotates the heating roller 58*b* of the fixing unit 58 and pre-run processing is executed (ST 35), so that the overall surface temperature by the heating roller 58*b* is made uniform.

The CPU 110 determines the end of the pre-run processing (ST 36) and is set in the ready state (ST 37) when other kinds of initial processing have terminated.

As described above, the error sensing time, which is to be compared with the successive ON time of the IH ON signal in the warming-up processing, is controlled on the basis of the amount of power used for the warming-up (WUP) processing, which is dependent upon the option-connected state. To be more specific, the error sensing time is controlled to be short when the amount of power is large, and to be long when it is small. When the amount of power is large, the fixing unit 58, more specifically the surface of the heating roller 58*b*, easily rises in temperature. This is why the error sensing time is controlled to be short. On the other hand, when the amount of power is small, the fixing unit 58, more specifically the surface of the heating roller 58, does not easily rise in temperature. This is why the error sensing time is controlled to be long.

In the pre-run mode, ready mode and print mode as well, the error sensing time, which is to be compared with the successive ON time of the IH ON signal, may be controlled on the basis of the amount of power, as in the warming-up processing described above. With the error sensing time controlled in this manner, the CPU 113 executes an error sensing operation.

[Third Embodiment]

In the first embodiment described above, reference was made to the case where the error sensing time was varied in accordance with the room temperature. This, however, does not limit the present invention. In the third embodiment, the error sensing time is varied on the basis of the room temperature and the amount of power consumed in the warming-up (WUP) processing, which is dependent on the option-connected state.

In the case of this embodiment, the internal memory 113*a* registers an error sensing time that is based on both the power amount (power setting) and the room temperature. The error sensing time is lengthened in accordance with a decrease in the power and a decrease in the room temperature. For example, the error sensing time is set at 30 seconds when the power setting is 1,300 W and the room temperature is 30°, at 90 seconds when the power setting is 1,300 W and the room temperature is 0°, at 35 seconds when the power setting is 1,250 W and the room temperature is 30°, at 100 seconds when the power setting is 1,250 W and the room temperature is 0°, at 40 seconds when the power setting is 1,200 W and the room temperature is 30°, at 110 seconds when the power setting is 1,200 W and the room temperature is 0°, at 45 seconds when the power setting is 1,100 W and the room temperature is 30°, and at 120 seconds when the power setting is 1,100 W and the room temperature is 0°.

Figure 9:
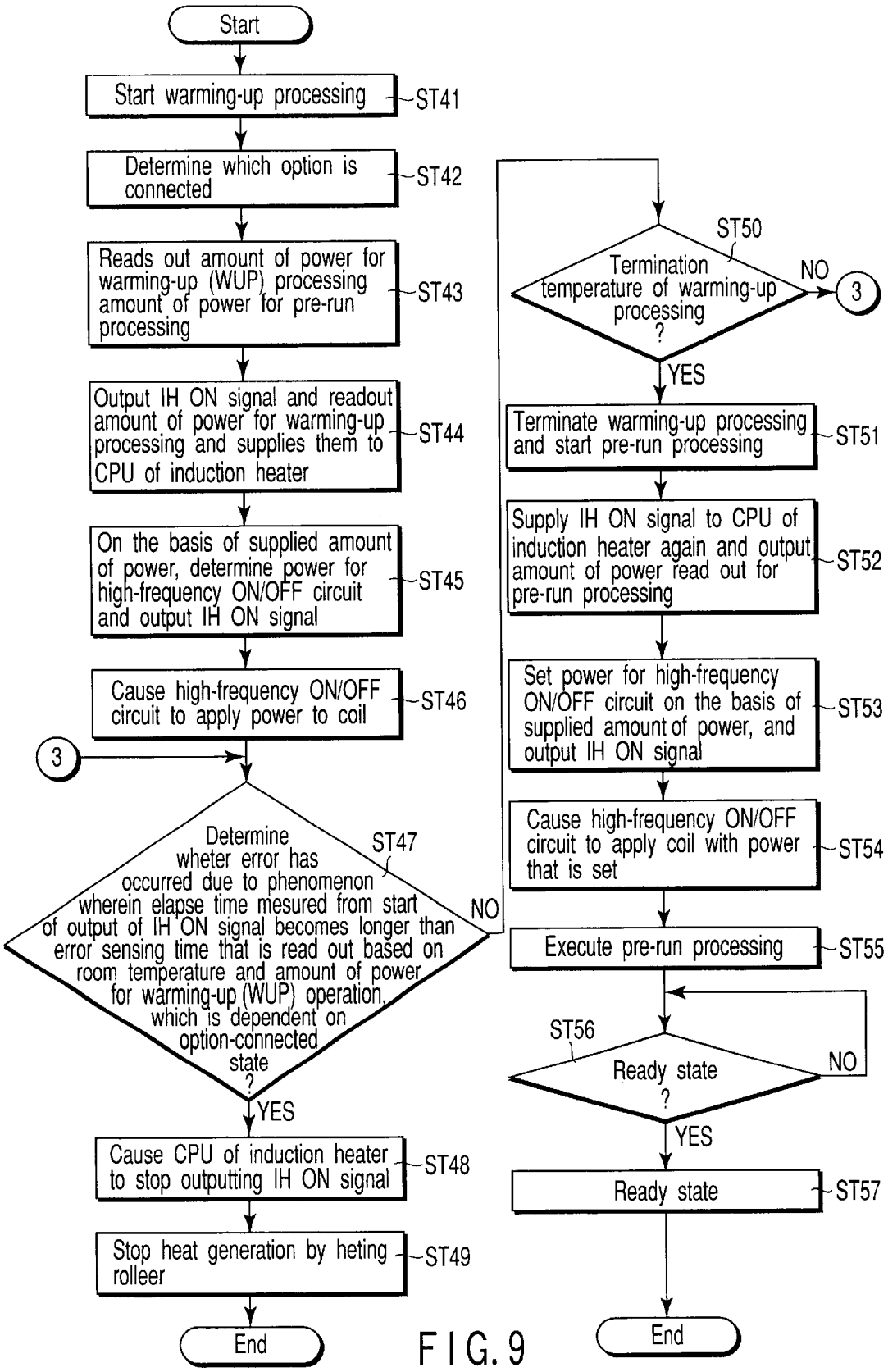
FIG. 9 is also a flowchart illustrating the warming-up processing and the error processing which the CPU of an induction heating apparatus executes during the warming-up processing.

How the above configuration operates will be described, referring to the case where the CPU 113 of the induction heating device 58*a* performs error processing in the warming-up mode. The description will be given with reference to FIG. 9.

When the power supply switch (not shown) is turned on, the CPU 110 of the main controller 90 determines the start of the warming-up processing (ST 41). Based on this determination, the CPU 110 makes inquiries to the connected devices and checks the states of the switches, thereby determining which option is connected (ST 42). Subsequently, on the basis of the options that have been determined as being connected, the CPU 110 searches the power setting table 94*a* and reads out the amount of power predetermined for the warming-up (WUP) processing and the amount of power predetermined for the pre-run processing (ST 43).

The CPU 110 outputs an IH ON signal and the readout amount of power (power setting) predetermined for the warming-up (WUP) processing and supplies them to the CPU 113 by way of the photocoupler 114 of the induction heating device 58*a* (ST 44).

On the basis of the supplied amount of power, the CPU 113 determines power for the high-frequency ON/OFF circuit 116, and supplies the IH ON signal it receives to the high-frequency ON/OFF circuit 116 (ST 45). While the CPU 113 supplies the IH ON signal, the high-frequency ON/OFF circuit 116 applies the power set by the CPU 113 to the coil through the output ports 117, 117 (ST 46).

Supplied with the high-frequency current from the high-frequency ON/OFF circuit 116, the coil 105 generates a high-frequency magnetic field. This high-frequency magnetic field causes an eddy current in the heating roller 58*b*. Due to the eddy current loss dependent upon the eddy current and the resistance of the heating roller 58*b*, the heating roller 58*b* generates heat.

In this state, the CPU 113 determines whether an error has occurred on the basis of an error sensing time and the elapse time measured from the start of output of the IH ON signal (ST 47). The error sensing time is read out from the internal memory 113*a* on the basis of the room temperature and the amount of power used for the warming-up (WUP) processing, which is dependent upon the option-connected state. If the elapse time is longer than the error sensing time, the occurrence of an error is determined. In the case where the CPU 113 determines the occurrence of an error, the CPU 113 stops outputting the IH ON signal (ST 48). As a result, the induction heating device 58*a* stops supplying a high-frequency current to the coil 105, and the heat generation by the heating roller 58*b* stops (ST 49).

If the occurrence of the error is not determined, and the CPU 110 determines that the surface temperature of the heating roller 58*b* detected by the thermistors 107*a* and 107*b* has reached the termination temperature of the warming-up processing (ST 50), then the CPU 110 determines the termination of the warming-up processing and the start of the pre-run processing (ST 51). In this case, the CPU 110 temporarily stops outputting the IH ON signal to the CPU 113 and starts outputting an IH OFF signal.

Then, the CPU 110 supplies the IH ON signal to the CPU 110 again, and outputs the amount of power read out for the pre-run processing (ST 52).

Then, the CPU 110 supplies the IH ON signal to the CPU 110 again, and outputs the amount of power read out for the pre-run processing (ST 52).

In this manner, the CPU 113 sets power for the high-frequency OH/OFF circuit 116 on the basis of the amount of power it receives, and supplies the IH ON signal it receives to the high-frequency ON/OFF circuit 116 (ST 53). While the IH ON signal from the CPU 113 is kept supplied, the high-frequency ON/OFF circuit 116 applies the power set by the CPU 113 to the coil 105 through the output ports 117, 117 (ST 54).

Applied with the high-frequency current by the high-frequency ON/OFF circuit 116, the coil 105 generates a high-frequency magnetic field. This magnetic field produces an eddy current in the heating roller 58*b*. The heating roller 58*b* generates heat, due to the eddy current loss dependent upon the eddy current and the resistance of the heating roller 58*b*.

In this state, the CPU 110 rotates the heating roller 58*b* of the fixing unit 58 and pre-run processing is executed (ST 55), so that the overall surface temperature by the heating roller 58*b* is made uniform.

The CPU 110 determines the end of the pre-run processing (ST 56) and is set in the ready state (ST 57) when other kinds of initial processing have terminated.

As described above, the error sensing time, which is to be compared with the successive ON time of the IH ON signal in the warming-up processing, is controlled on the basis of the room temperature and the amount of power used for the warming-up (WUP) processing, which is dependent upon the option-connected state. To be more specific, the error sensing time is controlled to be short when the amount of power is large and the room temperature is high, and to be long when the amount of power is small and the room temperature is low. When the amount of power is large and the room temperature is high, the fixing unit 58, more specifically the surface of the heating roller 58*b*, easily rises in temperature. This is why the error sensing time is controlled to be short in this case. On the other hand, when the amount of power is small and the room temperature is low, the fixing unit 58, more specifically the surface of the heating roller 58, does not easily rise in temperature. This is why the error sensing time is controlled to be long in this case.

In the pre-run mode, ready mode and print mode as well, the error sensing time, which is to be compared with the successive ON time of the IH ON signal, may be controlled on the basis of the amount of power and the room temperature, as in the warming-up processing described above. With the error sensing time controlled in this manner, the CPU 113 executes an error sensing operation.

[Advantages of the Embodiments]

As described above, even if an error occurs due to malfunction of the CPU 110, the coil 105 is not supplied with a high-frequency current, and the heating roller 58*b* is therefore prevented from being heated to a temperature higher than the predetermined temperature.

In addition, the error sensing time can be set in conformity with the environmental conditions, such as the room temperature.

Furthermore, the error sensing time can be set in conformity with the power setting, which is dependent on the option-connected state.

Moreover, the error sensing time can be set in conformity with both the environmental conditions, such as the room temperature, and the power setting which is dependent on the option-connected state.

According to the conventional art, if the CPU of the LGC (the regulation controller) of the main body operates in an abnormal way, the CPU of the LGC of the main body may output IH ON signals in succession. If this happens, the fixing unit is likely to overheat and even burn down in the worst case. This problem can be overcome by the present invention described in the foregoing.

As described above, even if the internal CPU of the induction heating device causes successive supply of IH ON signals, these IH ON signals are not supplied to the high-frequency ON/OFF circuit after the elapse of the error sensing time, which is determined based on the room temperature and/or the power setting dependent on the option-connected state. Hence, the high-frequency ON/OFF circuit stops oscillating, and a high-frequency current does not flow from the high-frequency ON/OFF circuit to the coil.

Thanks to this feature, dangerous phenomena, such as overheating or ignition, are prevented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus including a fixing unit that fixes a developer image onto a recording medium by utilization of heat generation by a heating roller, said image forming apparatus comprising:

a sensing section that senses a temperature of the heating roller;

an output section that outputs a driving signal based on the temperature sensed by the sensing section;

an environmental temperature sensing section that senses an environmental temperature at an installation site of said apparatus; and an induction heating device including: a coil that is received inside the heating roller; a high-frequency generation circuit that supplies a high-frequency current to the coil; a control element that outputs a control signal to the high-frequency generation circuit based on the driving signal output from the output section and that monitors a successive output time of the driving signal from the output section at different points of time corresponding to different temperatures sensed by the environmental temperature sensing section; and processing means for supplying the high-frequency current provided by the high-frequency generation circuit to the coil based on the control signal from the control element, said induction heating device producing an eddy current in the heating roller by causing the coil to generate a high-frequency magnetic field, and causing the heating roller to generate heat based on the eddy current.

2. An image forming apparatus according to claim 1, wherein, in an warming-up processing by which the heating roller is heated to a predetermined temperature in response to application of power supply, said control element performs a monitoring operation such that outputting the control signal to the high-frequency generation circuit is stopped when the successive output time of the driving signal from the output section has become longer than a first period of time in a state where the temperature sensed by the environmental temperature sensing section is a first temperature, and such that outputting the control signal to the high-frequency generation circuit is stopped when the successive output time of the driving signal from the output section has become longer than a second period of time, which is longer than the first period of time, in a state where the temperature sensed by the environmental temperature sensing section is a second temperature, which is lower than the first temperature.

3. An image forming apparatus enabling setting of a variety of options and including a fixing unit that fixes a developer image onto a recording medium by utilization of heat generation by a heating roller, said image forming apparatus comprising:

a sensing section that senses a temperature of the heating roller;

an output section that outputs a driving signal based on the temperature sensed by the sensing section;

a detecting section that detects a setting state of the options; and an induction heating device including: a coil that is received inside the heating roller; a setting section that determines amounts of power applied to the coil in an image formation mode and a standby mode based on the options that are set, during a warming-up processing when the heating roller is heated to a predetermined temperature in response to application of power supply; a high-frequency generation circuit that supplies a high-frequency current to the coil based on the amounts of power the setting section sets for the coil; a control element that outputs a control signal to the high-frequency generation circuit based on the driving signal output from the output section and that monitors a successive output time of the driving signal from the output section at different points of time corresponding to the setting of the options during the warming-up processing; and processing means for supplying the high-frequency current provided by the high-frequency generation circuit to the coil based on the control signal from the control element, said induction heating device producing an eddy current in the heating roller by causing the coil to generate a high-frequency magnetic field, and causing the heating roller to generate heat based on the eddy current.

4. An image forming apparatus enabling setting of a variety of options and including a fixing unit that fixes a developer image onto a recording medium by utilization of heat generation by a heating roller, said image forming apparatus comprising:

a sensing section that senses a temperature of the heating roller;

an output section that outputs a driving signal based on the temperature sensed by the sensing section;

an environmental temperature sensing section that senses an environmental temperature at an installation site of said apparatus; and an induction heater including: a coil that is received inside the heating roller; a setting section that determines amounts of power applied to the coil in an image formation mode and a standby mode based on the options that are set, during warming-up processing when the heating roller is heated to a predetermined temperature in response to application of power supply; a high-frequency generation circuit that supplies a high-frequency current to the coil based on the amounts of power the setting section sets for the coil; a control element that outputs a control signal to the high-frequency generation circuit based on the driving signal output from the output section and that monitors a successive output time of the driving signal from the output section at different points of time corresponding to the setting of the options and a temperature sensed by the environmental temperature sensing section during the warming-up processing; and processing means for supplying the high-frequency current provided by the high-frequency generation circuit to the coil based on the control signal from the control element, said induction heater producing an eddy current in the heating roller by causing the coil to generate a high-frequency magnetic field, and causing the heating roller to generate heat based on the eddy current.

* * * * *